US010119265B2

(12) United States Patent
Higgins

(10) Patent No.: US 10,119,265 B2
(45) Date of Patent: Nov. 6, 2018

(54) BUILDING FRAME CONNECTOR AND METHOD OF USE

(71) Applicant: Carbon Development Services, LLC, Denver, CO (US)

(72) Inventor: Brian Higgins, Denver, CO (US)

(73) Assignee: Carbon Development Services, LLC, Denver, CO (US)

( * ) Notice: Subject to any disclaimer, the term of this patent is extended or adjusted under 35 U.S.C. 154(b) by 0 days.

(21) Appl. No.: 15/290,910

(22) Filed: Oct. 11, 2016

(65) Prior Publication Data

US 2017/0130444 A1 May 11, 2017

Related U.S. Application Data

(60) Provisional application No. 62/251,211, filed on Nov. 5, 2015.

(51) Int. Cl.

| | |
|---|---|
| ***E04B 1/24*** | (2006.01) |
| ***E04B 1/19*** | (2006.01) |
| ***E04B 1/41*** | (2006.01) |

(52) U.S. Cl.

CPC ..... *E04B 1/1909* (2013.01); *E04B 1/40* (2013.01); *E04B 2001/1918* (2013.01); *E04B 2001/1957* (2013.01)

(58) Field of Classification Search

CPC ..... E04B 1/2403; E04B 2001/2415; E04B 1/1909; E04B 2001/2448; E04B 2001/2454; E04B 2001/2457; E04B 2001/1963; E04B 2001/2463; E04B 2001/3247; E04B 1/3211; E04B 2001/3294; E04B 2001/1927; E04B 2001/1933; Y10T 403/341; Y10T 403/345; Y10T 403/39; Y10T 403/343; Y10T 403/342

See application file for complete search history.

(56) References Cited

U.S. PATENT DOCUMENTS

| | | | | |
|---|---|---|---|---|
| 1,102,502 A | | 7/1914 | Hansbrough | |
| 2,959,256 A | | 11/1960 | Deam | |
| 3,688,461 A | * | 9/1972 | Rensch | E04B 1/19 403/174 |

(Continued)

FOREIGN PATENT DOCUMENTS

| | | |
|---|---|---|
| EP | 2767642 A1 | 8/2014 |

*Primary Examiner* — James M Ference
*Assistant Examiner* — Kyle J. Walraed-Sullivan
(74) *Attorney, Agent, or Firm* — Husch Blackwell LLP

(57) ABSTRACT

A building frame connector for connecting beams to columns to create a building frame. The building frame connector includes a pin member and plurality of fins mounted on said pin member for rotation relative to said pin. The pin may be in alignment with the column, and the fins allow connection of the beams to the columns. The fins may be disposed to rotate relative to said pin member about a longitudinal axis of the pin. In one embodiment the pin member may have an outer diameter and the fins have a collar with an inner diameter is greater than said outer diameter of said pin allowing for the collars to rotate about the pin member. The present building frame connector may also include at least one coupling member coupled to the pin member, wherein the coupling member facilitates the connection of the building frame connector to a building column.

8 Claims, 6 Drawing Sheets

(56) References Cited

U.S. PATENT DOCUMENTS 3,851,601 A * 12/1974 Davis ..... A47B 87/0215 108/158.11
4,036,371 A * 7/1977 Michel ..... A47B 47/021 211/182
4,260,276 A * 4/1981 Phillips ..... E04B 1/2403 403/172
4,379,649 A * 4/1983 Phillips ..... E04B 1/1909 403/172
4,432,661 A * 2/1984 Phillips ..... E04B 1/3211 403/172
4,484,430 A * 11/1984 Rossman ..... E04B 1/1909 403/174
4,566,818 A * 1/1986 Schwartz ..... E04B 1/1909 403/172
4,577,449 A 3/1986 Celli
4,745,412 A * 5/1988 Creaser, Jr. ..... H01Q 1/1242 343/890
4,844,649 A * 7/1989 Vandenboom ..... E04B 1/3211 403/172
4,904,108 A * 2/1990 Wendel ..... E04B 1/1912 403/170
4,905,436 A 3/1990 Matsuo et al.
4,988,230 A * 1/1991 Banthia ..... A47B 47/0008 403/170
5,540,013 A * 7/1996 Diamond ..... E04B 1/32 52/646
6,205,739 B1 * 3/2001 Newlin ..... E04B 1/19 52/645
6,237,298 B1 * 5/2001 Castano ..... E04B 1/3211 403/170
6,286,282 B1 * 9/2001 Castano ..... E04B 1/3211 403/171
6,332,657 B1 * 12/2001 Fischer ..... A47B 47/0008 312/111
6,814,184 B1 * 11/2004 Blinn, Jr. ..... E04G 1/08 182/141
7,146,770 B2 12/2006 Simmons
7,823,347 B1 * 11/2010 Blinn ..... B66C 23/62 182/186.7
8,161,707 B2 4/2012 Simmons
8,615,960 B2 * 12/2013 Marcotte ..... F24J 2/14 52/638
2003/0041549 A1 * 3/2003 Simmons ..... E04B 1/2403 52/655.1
2003/0172612 A1 * 9/2003 Simmons ..... E04B 1/24 52/648.1
2005/0040312 A1 * 2/2005 Tsai ..... F16B 7/185 248/618
2005/0084324 A1 * 4/2005 Dubensky ..... E04B 1/3483 403/305
2006/0265992 A1 * 11/2006 Hiragaki ..... E04B 1/2403 52/633
2007/0274771 A1 * 11/2007 Chang ..... E04G 7/307 403/187
2009/0087255 A1 * 4/2009 Jorna ..... F16B 7/0453 403/171
2009/0313938 A1 * 12/2009 Li ..... E04B 1/19 52/656.9
2010/0005752 A1 * 1/2010 Hawkins ..... E04B 1/1903 52/655.1
2010/0132286 A1 6/2010 Hovey, Jr.
2011/0252743 A1 10/2011 Yang
2015/0167290 A1 * 6/2015 Puritani ..... E04B 1/1909 52/650.1
2016/0097192 A1 * 4/2016 Marquina ..... E04B 1/24 52/655.1

* cited by examiner

BUILDING FRAME CONNECTOR AND METHOD OF USE

CROSS REFERENCE TO RELATED APPLICATIONS

This application claims the benefit of U.S. Provisional Patent Application No. 62/251,211 filed Nov. 5, 2015, the entire disclosure of which is hereby incorporated by reference.

BACKGROUND OF THE INVENTION

As an architect with a background in structural engineering, the inventor became frustrated with the current building methods and their inefficiencies. In typical conventional wood frame construction, load bearing stick-framed walls are crafted on site by skilled craftsmen and provide the structural skeleton of each building. In certain markets, there is an increased demand for these skilled carpenters, which is driving up costs of construction and stalling out projects. Moving to a non-load bearing wall design with post and beam construction speeds up the construction time and allows for increased use of less skilled labor.

Typical construction methods often use "hinged" connections as these connections are the easiest and cheapest connection to effectuate during construction. However, it is well recognized in the art that the creation of "fixed-end" moment frames are a more material efficient building component and allows for smaller members, but provides similar or improved performance. Thus, there is also a need in the wood framing construction industry to create an economical beam to column connection which provides performance of a fixed-end or "moment frame" construction.

The present invention is a building frame connector that addresses these shortcomings in the art and provides a building method of improved efficiency from both the cost of labor and the cost of materials.

BRIEF SUMMARY OF THE INVENTION

A building frame connector that is a structural node used in building construction. The present building frame connector may be used to join multiple beams to a steel column in in a single plane. The present building frame connector may be used for mounting a beam to a column in residential or commercial construction. The building frame connector may include a pin member and a plurality of fins mounted on the pin member for rotation relative to the pin. The pin member may have a first end, a second end, and a longitudinal axis passing through the first end and the second end. The fins may be mounted or disposed on the pin for rotation relative to the pin member about the longitudinal axis.

The fins may have one or more collars mounted thereon, wherein the collars have an inner diameter. The pin member may have an outer diameter. Thus, the collars' inner diameter may be greater than the outer diameter of the pin such that the collars may be mounted for rotation on the pin. The building frame connector may also include a coupling member coupled to a first end and/or a second end of the pin. The coupling member may be a tubular shape and have inner dimension sized for connecting the pin (and fins mounted thereon) to a column of a building. The present building frame connector may include a bearing plate coupled to or a component of one or more of the fins. The bearing plate may be positioned at the bottom of the fin and may have a width and length allowing the fin to support a beam of the building frame.

The present building frame connector may be used in a method of erecting a building frame. One step may include coupling the present building frame connector to a building column. The construction of the present building frame connector allows for adjusting an angular orientation of the fin relative to the pin by rotating the fin relative to the pin for setting the position of the fin to match the building frame member layout and/or adjust the position of the fin on-site to accommodate fabrication errors. The present method may also include bearing a beam on one of the bearing plates of one of the fins, and the coupling the beam to the fin after it is bearing on the bearing plate. The present building frame connector may have multiple fins and, thus, each beam of a building frame may be connected to a respective column using the present building frame connector.

It is contemplated that one or two version of the present building frame connector may be used in a single structure and throughout the project. This would realize efficiencies in fabrication due to standardization of connectors and reduce errors in the erection of members. However, it is also contemplated that more than two versions of the present building frame connector may be implemented on the project based upon loading requirements. Efficiencies in this manner could be obtained by having a pre-determined number of standard sized connections corresponding to a range of loading conditions. A designer could designate the type or size of connection to be used at each location on the plan. This may also result in similar reductions in fabrication costs as only a few standard sizes of the present building frame connector would be available, and would add savings on material costs as smaller members could be used with smaller loading requirements. Other custom fabrication embodiments are also envisioned.

Other aspects and advantages of the present invention will be apparent from the following detailed description of the preferred embodiments and the accompanying drawing figures.

BRIEF DESCRIPTION OF THE SEVERAL VIEWS OF THE DRAWING

The accompanying drawings form a part of the specification and are to be read in conjunction therewith, in which like reference numerals are employed to indicate like or similar parts in the various views.

DETAILED DESCRIPTION OF THE INVENTION

The following detailed description of the present invention references the accompanying drawing figures that illustrate specific embodiments in which the invention can be practiced. The embodiments are intended to describe aspects of the present invention in sufficient detail to enable those skilled in the art to practice the invention. Other embodiments can be utilized and changes can be made without departing from the spirit and scope of the present invention. The present invention is defined by the appended claims and, therefore, the description is not to be taken in a limiting sense and shall not limit the scope of equivalents to which such claims are entitled.

Figure 1:
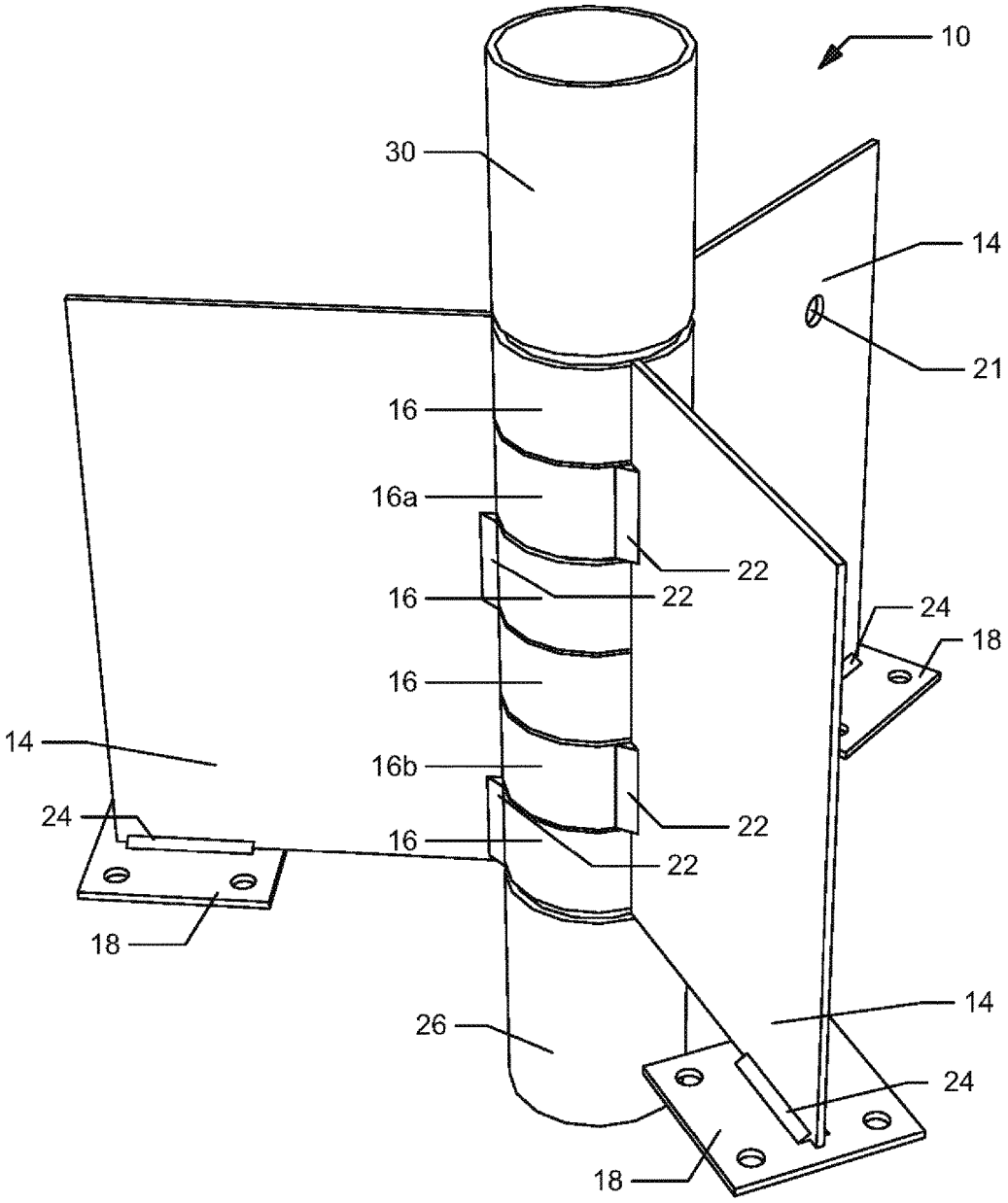
FIG. 1 is a perspective view of one embodiment of a building frame connector in accordance with the teachings of the present disclosure.

The present invention is directed toward a building frame connector 10 which is a structural node used in building construction that joins multiple beams to a steel column and allows for on-site vertical and angular orientation adjustment. Turning to FIG. 1, building frame connector 10 includes a pin member 12 (see FIGS. 2, 3 and 5) and a plurality of fins 14 which are attached to pin member 12 using at least one collar 16. FIG. 1 illustrates an embodiment of the present invention wherein each fin 14 is connected to two collars 16*a* and 16*b* (see FIG. 2). However, it will be appreciated that alternative embodiments including a single collar or three or more collars may be incorporated depending upon the number of beams supported, the magnitude of the loads carried and the desired aesthetic appearance.

Each fin 14 may also include a bearing plate 18 for supporting the bottom of a beam during installation and for transferring load to fin 14. Bearing plates 18 may be positioned on each fin 14 and coordinated with the beam height to set the floor plane for the floor level being supported by the beams. Fin 14 will be recognized in FIG. 1 as a rectangular plate wherein collars 16 are mounted on one side of the plate. Fin 14 may alternatively be a WT shape section (not-shown) with the web being vertically orientated and the flange disposed below the web when installed. Alternatively, in another embodiment, fin 14 may be a U-shape section (not shown) that is either vertically orientated so that the beam is received into the U-shape from the side using bolts to create a shear connection, or orientated as a saddle to receive the beam in a bearing condition. Connection of these alternative fin embodiments to collars 16 would be well within the skill of a person skilled in the art given the disclosure herein.

To simplify construction, beams of the same beam depth may be used to allow for beams to be erected independent of a particular fin 14 in the present building frame connector 10. However, it is also possible for the bearing plate 18 to be positioned on one or more of the fins 14 of building frame connector 10 at a differing height in order to accommodate beams of different heights or to provide a step-down or step-up in the finished floor as dictated by the design. Each bearing plate 18 may also include one or more pre-drilled bolt holes 20 (see FIG. 3) through which the end of a supported beam may be fastened to bearing plate 18 and building frame connector 10. Fins 14 may also include one or more vertically orientated holes 21 through which bolts or other fastening devices may be used to connect a beam on the fin 14. In one embodiment, fin 14 may be fastened to collar 16 through a weld 22 and bearing plate may be fastened to fin 14 using another weld 24.

Figure 2:
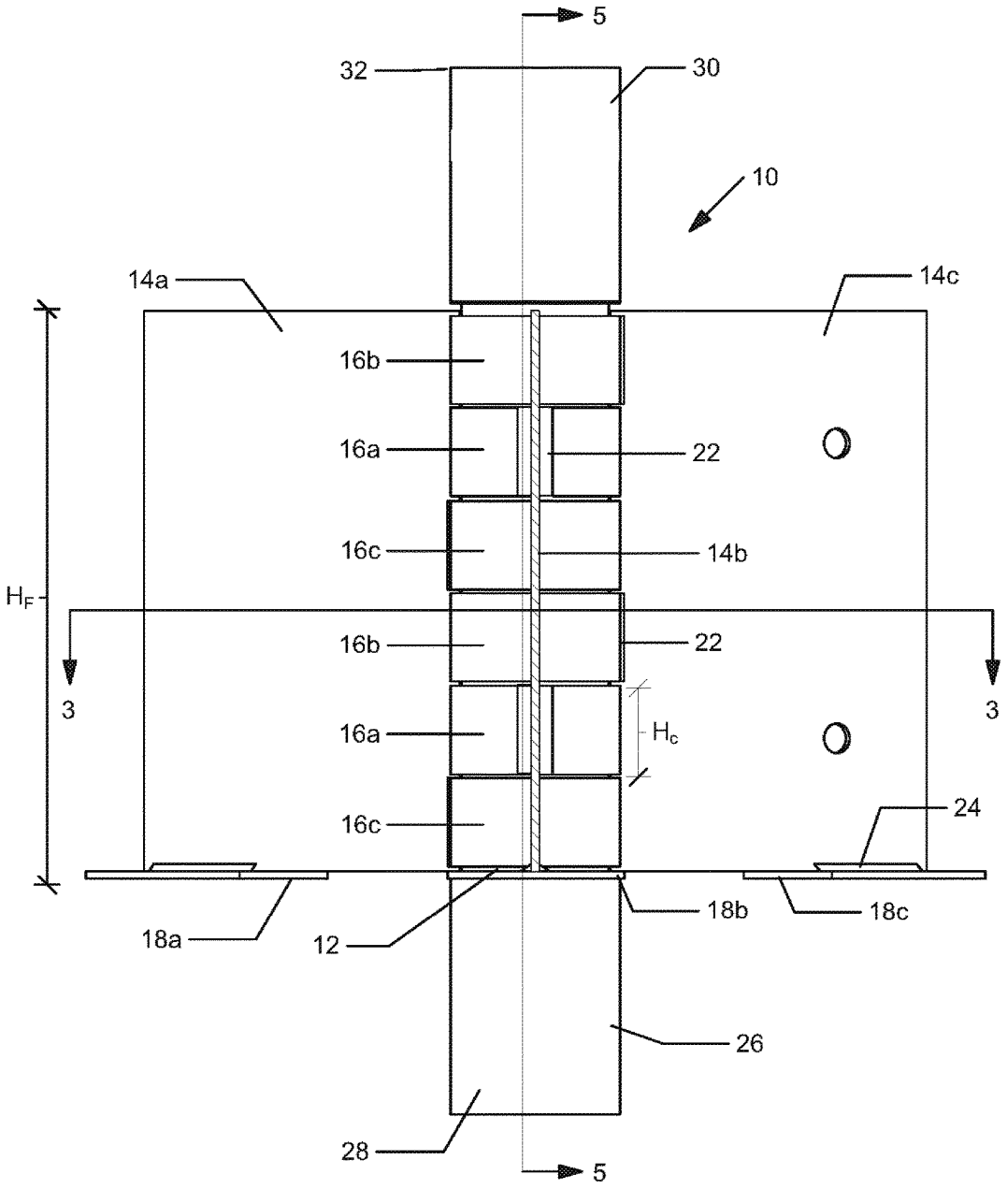
FIG. 2 is a side view of one embodiment of a building frame connector in accordance with the teachings of the present disclosure.

As best shown in FIG. 2, one embodiment includes building frame connector 10 having three fins 14*a*, 14*b*, and 14*c*, with each fin 14*a*, 14*b*, and 14*c* mounted on or attached to pin 12 using pairs of collars 16*a*, 16*b*, and 16*c*. Each respective fin 14*a*, 14*b*, and 14*c* includes a corresponding bearing plate 18*a*, 18*b*, and 18*c*. This configuration would be particularly applicable for use on an exterior side of a building with an interior column. In another embodiment, four fins 14 may be mounted on or operably connected to pin 12 using four distinct coupling elements, wherein a pair of collars 16 may constitute a coupling element as illustrated. As shown in FIG. 2, the height of fin 14 $H_f$ may correspond to the aggregate height of collars 16, wherein each collar having a height $H_c$. This embodiment of building frame connector 10 allows the desired number of collars 16 associated with each fin 14 to be slid over pin 12 and secured in position by attaching lower coupling member 26 and upper coupling member 30 (when applicable) to hold the collars in place during transport and erection of the columns and building frame connector 10. In another embodiment, particularly if each fin includes two or more collars 16, the collars 16 of the respective fins may be aligned and the pin inserted through the aligned collars 16.

Further, building frame connector 10 may include a lower coupling member 26 at the building frame connector's bottom end 28. Lower coupling member 26 may be used to connect building frame connector 10 to the building columns (see FIG. 6) extending upward from the floor below. In embodiments used at the intermediate floors of a building, building frame connector 10 may also include and upper coupling member 30 at a top end 32 of the building frame connector 10. However, some embodiments may not include upper coupling member 30, particularly for situations where there is no upper column located above the lower column, such as the roof level or other similar condition within the building where there is no upper column above the respective floor.

Figure 3:
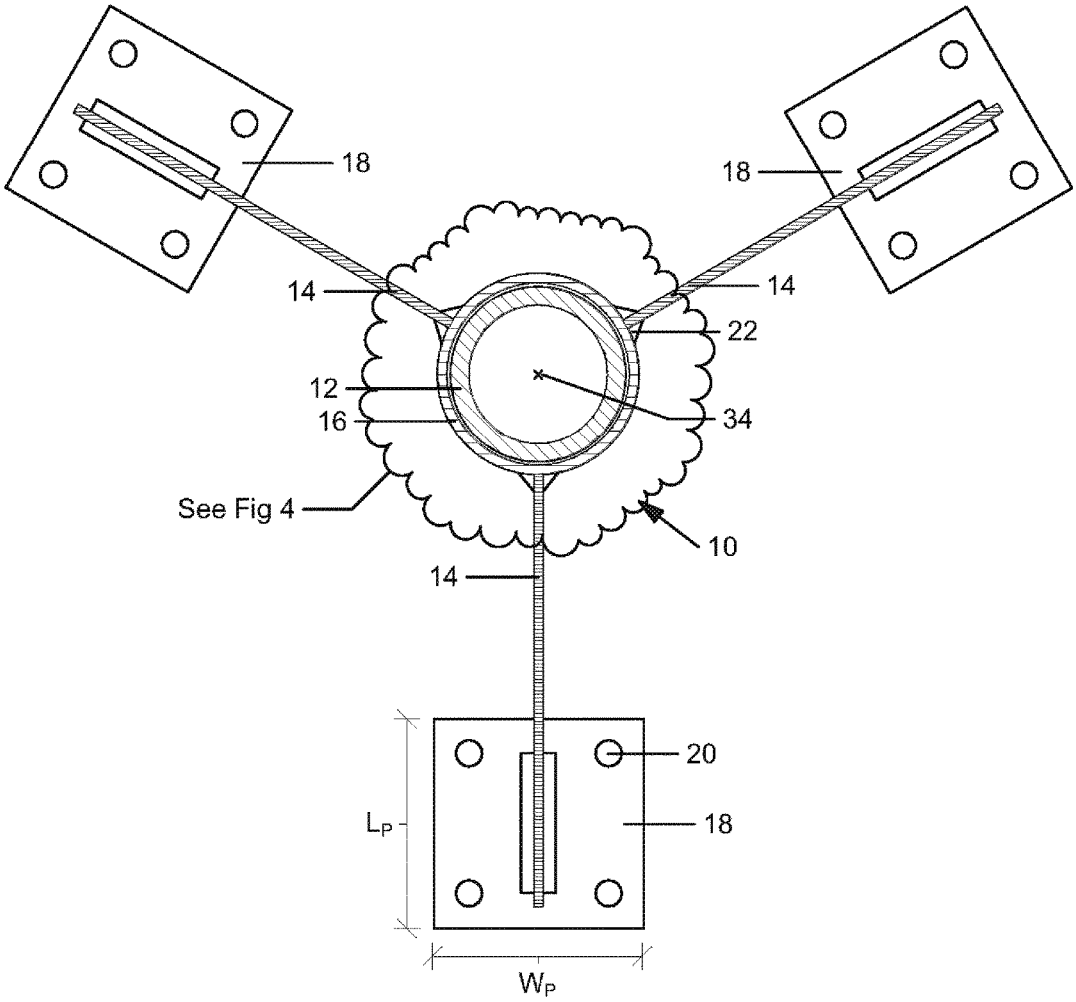
FIG. 3 is a sectional view of the embodiment of a building frame connector of FIG. 2 cut along the line 3-3.
Figure 4:
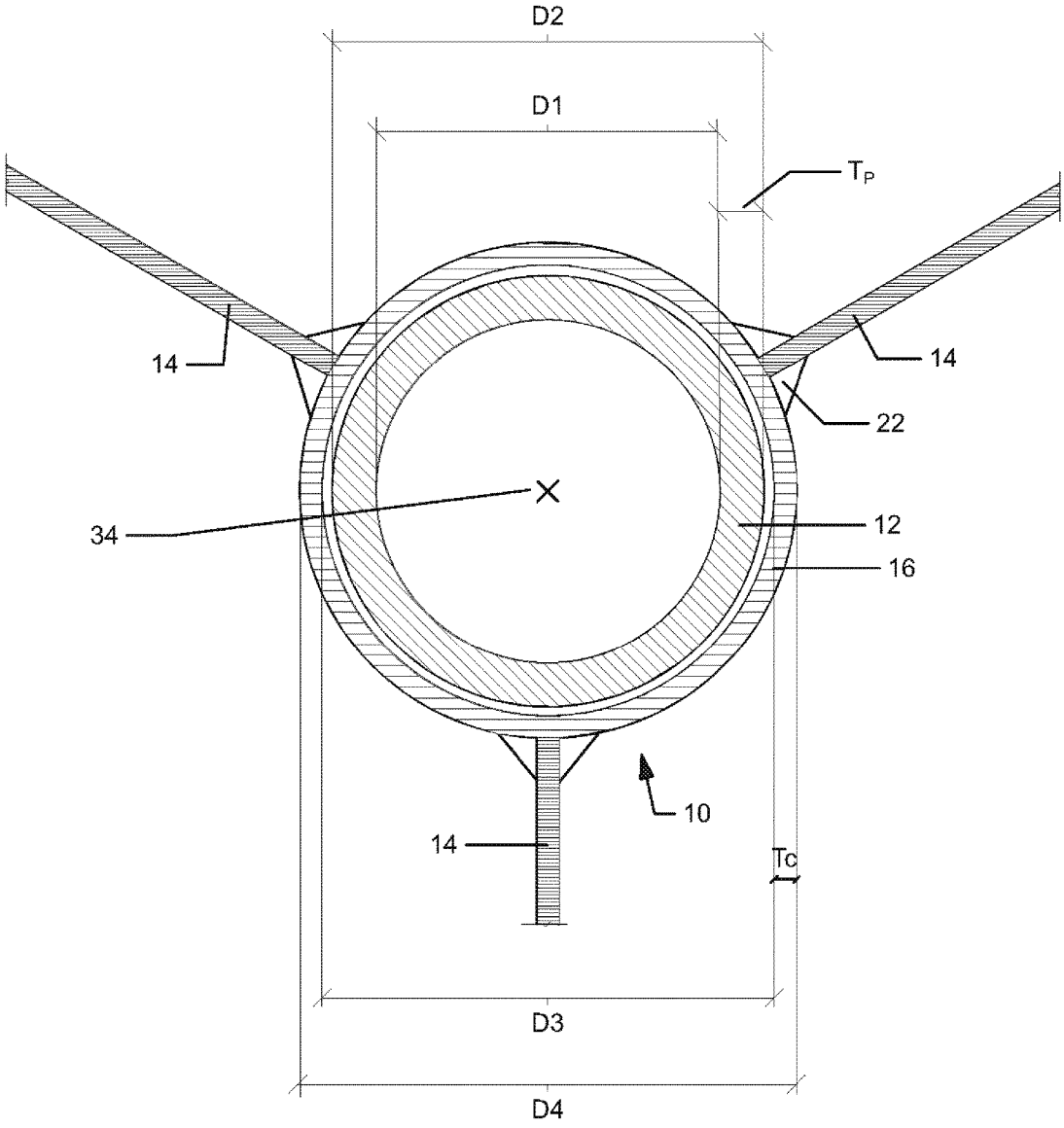
FIG. 4 is an enlarged view of the sectional view of FIG. 3.

FIG. 3 illustrates the radial distribution of fins 14 about pin 12. FIG. 3 also shows that bearing plate 18 has a bearing plate length Lp and a bearing plate width Wp. The configuration of collars 16 as mounted on pin 12 allow for this radial distribution to be adjusted and the position of each fin may be adjusted on site or as necessitated by fabrication or erection errors. Further, as best shown in FIG. 4, pin member 12 may be a hollow pipe section having a pin inner diameter D1 and a pin outer diameter D2 which share a common center point 34. The distance between pin inner diameter D1 and pin outer diameter D2 is the pin wall thickness Tp. In lighter building applications pin 12 may also be a solid rod. As further illustrated in FIG. 2, collar 16 includes a collar inner diameter D3 and a collar outer diameter D4, wherein collar inner diameter and collar outer diameter also share center point 34. The distance between collar inner diameter D3 and collar outer diameter D4 is the collar wall thickness Tc. In the embodiment shown in FIG. 4, collar inner diameter D3 is slightly greater than the pin outer diameter D2 to allow collar 16 to be positioned outside the pin 12 as shown. This configuration also allows collars 16 to rotate freely around pin 12. In one embodiment, collars 16 rotate about a vertical axis passing through center point 34. In another embodiment, this vertical axis corresponds to the longitudinal axis of pin 12.

Figure 5:
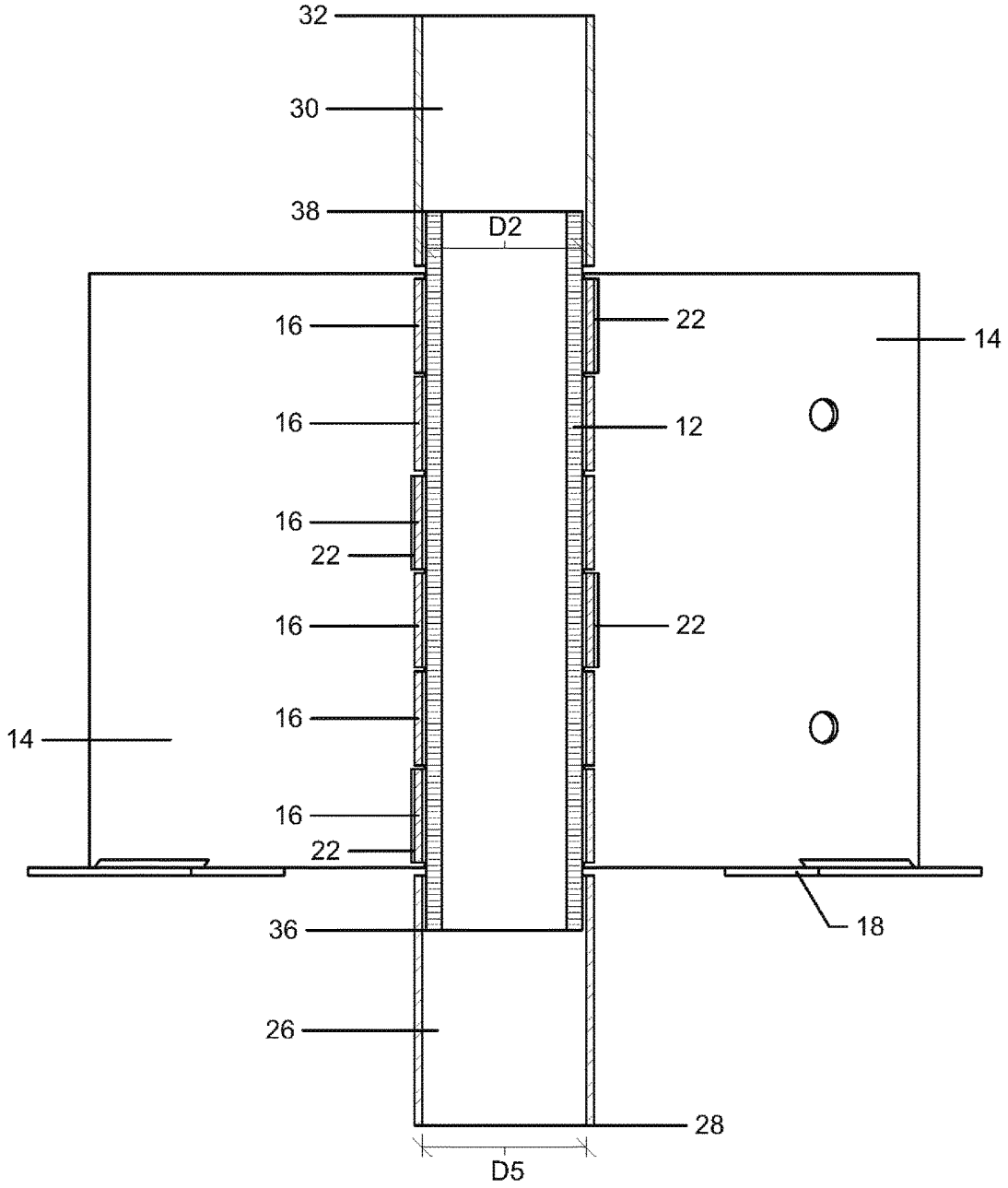
FIG. 5 is a sectional view of the embodiment of a building frame connector of FIG. 2 cut along the line 5-5.

FIG. 5 illustrates a section view of the present building frame connector 10 showing pin 12 having a lower end 36 and an upper end 38. Both lower and upper coupling members 26 and 30 include an inner diameter D5. As shown, inner diameter D5 of lower coupling member 26 is greater than outer diameter D2 of pin 12 thereby allowing lower coupling member 26 to receive lower end 36 of pin 12. Lower coupling member 26 may be fastened to pin 12 through a weld or other similar fastener known in the art. A similar case exists in embodiments wherein the present building frame connector 10 is used in a mid-floor location and a column for an upper story extends upward of the upper end 38 of pin 12. As shown in FIG. 5, upper end 38 of pin 12 is received into upper coupling member 30.

Figure 6:
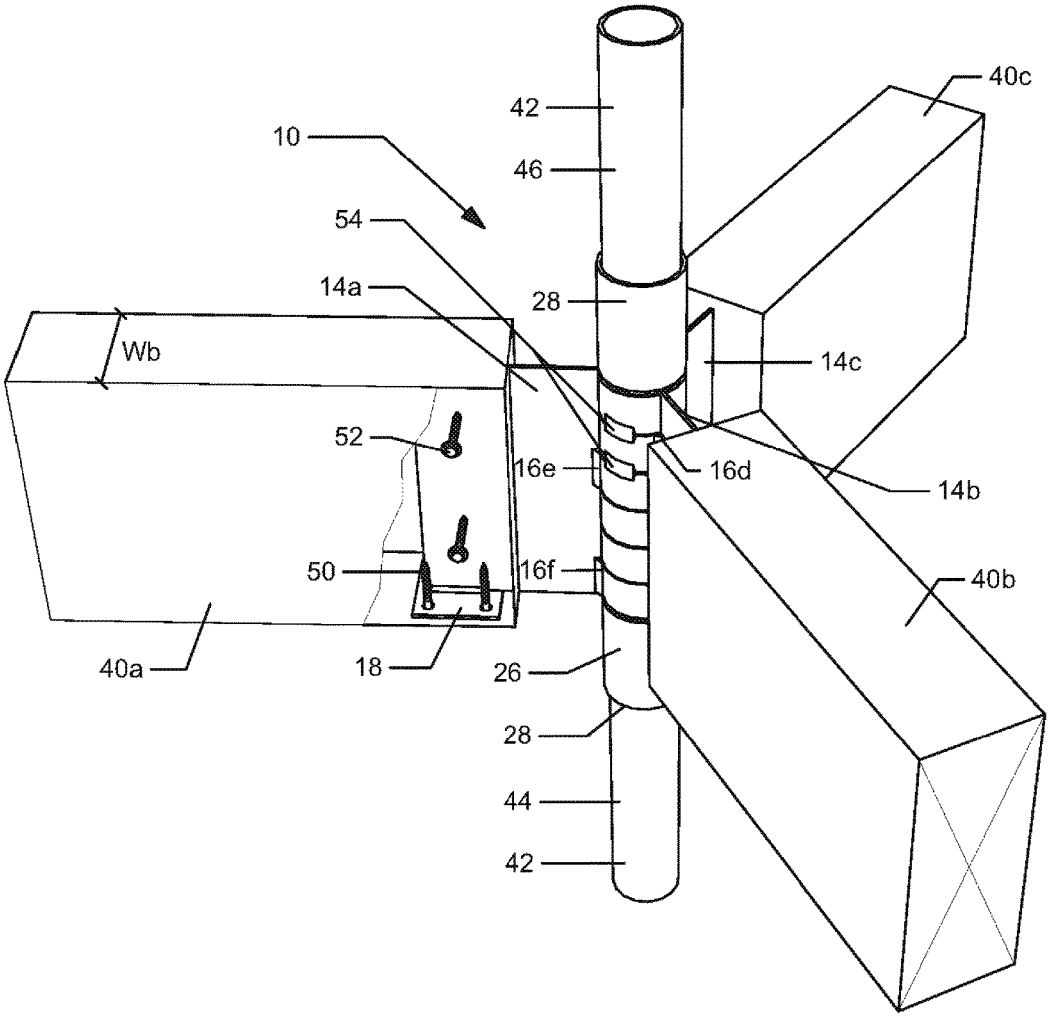
FIG. 6 is a perspective view of an embodiment of a building frame connector in accordance with the teachings of the present disclosure with beams supported in an erected configuration.

Now turning to FIG. 6, building frame connector 10 is shown joining multiple beams 40 to columns 42. Beams 40 are preferably wood, but could be steel, aluminum, plastic, or carbon fiber. Columns 42 are preferably steel, but other materials such as wood, aluminum, plastic, or carbon fiber are also within the scope of the present invention, with wood and steel being the more common building materials. As shown in FIG. 6, building frame connector 10 includes three fins 14*a*, 14*b*, and 14*c* that support three respective beams 40*a*, 40*b*, and 40*c*. As shown, building frame connector 10 is positioned between lower column 44 and upper column 46. Beams 40 may be fabricated to include a cut-out portion 48 centered on beam 40 and which is sized to receive fin 14 as shown. Beams 40 have a width Wb which is similar to width Wp of bearing plate 18. Beams 40 may be coupled to bearing plate 18 and fin 14 using one or more of a plurality of bottom fasteners 50 inserted through bolt holes 20 of bearing plate 18, and/or side fasteners 52. Fasteners 50 and 52 may be through bolts, lag bolts, nails, screws, adhesives, chemical or physical welds, or other known fastening method. A person of skill in the art will appreciate that an embodiment of building frame connector 10 maybe configured to provide a structural fastening connections between the fins 14, bearing plates 18 and the beams 40 which allows the structure to be engineered with the beams 40 having "fixed ends" as opposed to "hinged ends." This more rigid connection, particularly when used consistently throughout the structure, provides the ability to substantially reduce the size, weight and cost of the columns and provides improved structural redundancy. This is a desirable condition, particularly when designing the structure to withstand lateral loading due to wind and seismic events.

In another embodiment (not shown), a top plate (not shown) may be provided on a fin 14 opposite bearing plate 18 to provide additional rotational restraint on the beam 40. In such an embodiment, a section of the length of a WF shape or I-beam may be used as a combination of fin 14, bearing plate 18 and the top plate (not shown). A person of skill in the art would appreciate that a portion of the top and bottom flanges of such WF shape or I-beam shape would preferably be removed to provide the radial adjustment of each member about pin 12.

In addition, as shown in FIG. 6, an embodiment is shown wherein each fin 14 includes a single collar 16*d*, 16*e*, and 16*f*. This alternative embodiment retains the ability of collars 16*d-f* to rotate freely in relation to pin 12 and due to the fact that the collars 16*d-f* are free to rotate and not tacked or fixed to pin 12 the orientation of the beams with respect to each other may be set allowing for some adjustment in the field. FIG. 6 illustrates an embodiment wherein beams 40*a*, 40*b*, and 40*c* are radially arranged at substantially equidistant angles around pin 12. However, beams 40 may be orientated at right angles or additional fins 14 may be mounted to pin 12 using additional collars 16 to have any number of beams with any desired angular configuration. Since the fins 14 on the present building frame connector 10 are rotatable about pin 12, beams 40 may be mounted to the columns 44 and/or 46 and may be arranged in any angular orientation in the plane of the floor on site.

In use, a building's foundations would be typically constructed for the designed height and loading requirements. The building frame would replace the construction of structural wood-stick walls, so columns would be located in the desired configurations. Upon installing the columns from the ground floor up to the next floor, the present building frame connector 10 would be installed on the upper end of each column using a column splice or connection method known in the art. The vertical position of building frame connector 10 is preferably set prior to installing the beams, but if a sleeve coupling/connector is used, then the vertical position of building frame connector 10 may be adjusted after the beams are installed, allowing for field adjustment to ensure the frame is set at the correct floor elevation. It is preferable that a framing contractor is able to install each building frame connector 10 and the respective beams 40 with one or two workers and, in one embodiment, building frame connector 10 is fabricated to eliminate cutting, bolting and metal strapping.

The beams 40 would be installed between columns 42 in the desired building grid layout. Each fin 14 of building frame connector 10 is independently moveable. Thus, an installer can orientate the fins. 14 to a position required to connect adjacent columns 42 as dictated in the design prior to installing the beams. In addition, fins 14 may be radially adjusted with respect to pin 12 during installation of the beams 40 to accommodate fabrication errors. Accordingly, the radial adjustment provided by building frame connector 10 allows for positioning elements on site and small on-site adjustments which speed-up erection and accommodate any slight fabrication errors. As shown in FIG. 6, finish welds 54 may be made to tie the collars 16 together and/or fix collars 16 to the coupling members 26 and 30 once the beams 40 are connected to all adjacent columns 42. This fuses the collars 16 in place and also connects them to work in concert with pin 12 to carry load to the columns 42. The interior walls can then be built as non-structural partition walls. Depending upon the desired aesthetic appearance, building frame connector 10, beams 40 and/or columns 42 can be left exposed or wrapped with wood or drywall. In addition, any other desired building surface finish known in the art may be used to hide the connections and/or structural members.

As would be expected, once the beams of the applicable floor are erected, the columns for the next floor above may be erected. In fact, the columns for the next floor may even be erected prior to placing the beam in certain circumstances. Then beams for the next floor are connected to the columns using the building frame connector 10. The erection of columns and beams may then be repeated until the roof beams are installed.

As is evident from the foregoing description, certain aspects of the present invention are not limited to the particular details of the examples illustrated herein. It is therefore contemplated that other modifications and applications using other similar or related features or techniques will occur to those skilled in the art. It is accordingly intended that all such modifications, variations, and other uses and applications which do not depart from the spirit and scope of the present invention are deemed to be covered by the present invention.

Other aspects, objects, and advantages of the present invention can be obtained from a study of the drawings, the disclosures, and the appended claims.

The invention claimed is:

1. A building frame connector for mounting a beam to a column in residential or commercial construction, the building frame connector comprising:

a pin member, said pin member configured for connection to at least one column, said pin member includes a first end, a second end, and a longitudinal axis passing through said first end and said second end; and a plurality of fins mounted on said pin member for rotation relative to said pin member about said longitudinal axis;

each fin of the plurality of fins configured to connect to one beam to said one column; and each fin of the plurality of fins configured for rotation relative to each individual other fin of the plurality of fins mounted on said pin member;

wherein each of said plurality of fins includes a bearing plate, said bearing plate being disposed at a bottom of said fin and orientated in plane substantially perpendicular to the longitudinal axis of said pin member.

2. The building frame connector of claim 1, wherein said pin member includes an outer diameter; and wherein each of said plurality of fins have one or more collars mounted thereon, said collars having an inner diameter that is greater than said outer diameter of said pin member, said collars receiving said pin member to mount each of said plurality of fins on said pin member.

3. The building frame connector of claim 2 further comprising a coupling member coupled to one of said first end or said second end of said pin member, said coupling member sized for connection to a column of a building.

4. A building frame connector comprising:

a pin member that includes a first end, a second end, and a longitudinal axis passing through said first end and said second end, and said pin member having an outer diameter;

a plurality of fins mounted to said pin member, each of said fins configured for connecting a beam member to the building frame connector, the plurality of fins comprising at least a first fin having a first collar and a second collar, and a second fin having a third collar and a fourth collar, wherein each of said collars has an inner diameter that is greater than said outer diameter of said pin member and said collars disposed on said pin member and configured for rotation relative to said pin member and to said collars of each individual other fin of the plurality of fins about said longitudinal axis, and wherein said third collar is disposed along said pin member between said first collar and said second collar; and each of the fins having a bearing plate mounted thereon, said bearing plate disposed proximate a bottom of said fin, and orientated in a plane substantially perpendicular to said longitudinal axis; and having a bearing plate width sized to support a beam member of a building frame; and at least one coupling member coupled to one of said first end or said second end of said pin member, said coupling member sized for connection to a column of a building.

5. A method for erecting a building frame comprising:

coupling a building frame connector to a building column, said building frame connector comprising a pin member and a plurality of fins, each of said plurality of fins having one or more collars, said one or more collars receiving said pin member to pivotally mount each of said plurality of fins to said pin member;

adjusting an angular orientation of a first fin of said plurality of fins relative to a longitudinal axis of said pin member and each individual other fin of the plurality of fins by rotating said first fin relative to said pin member about said longitudinal axis and said each individual other fin of the plurality of fins about said longitudinal axis; and bearing a first beam on a first bearing plate of said first fin, wherein said first bearing plate is disposed proximate a bottom of said first fin and orientated in a plane substantially perpendicular to said longitudinal axis;

coupling said first beam to said first fin after the step of bearing said first beam on said first bearing plate.

6. The method of claim 5, further comprising the steps of:

adjusting an angular orientation of a second fin of said plurality of fins relative to said pin member, said first fin, and each individual other fin of the plurality of fins by rotating said second fin relative to said pin member, said first fin, and said each individual other fin of the plurality of fins; and bearing a second beam on a second bearing plate of said second fin, wherein said second bearing plate is disposed proximate a bottom of said second fin and is orientated in a plane substantially perpendicular to said longitudinal axis;

coupling said second beam to said second fin after the step of bearing said second beam on said second bearing plate.

7. The building frame connector of claim 1, wherein the plurality of fins comprises at least a first fin having a first collar and a second collar, and a second fin having a third collar and a fourth collar, wherein each collar has an inner diameter that is greater than an outer diameter of said pin member and said pin member is received through each said collar to mount said first fin and said second fin to said pin member; and wherein said third collar is disposed along said pin member between said first collar and said second collar.

8. The building frame connector of claim 1, wherein each bearing plate of each fin is disposed in a plane orientated substantially perpendicular to a longitudinal plane of each respective fin.

* * * * *